United States Patent [19]

Nishimura

[11] Patent Number: 4,625,671

[45] Date of Patent: Dec. 2, 1986

[54] SAILING SYSTEM

[76] Inventor: Thomas G. Nishimura, P.O. Box 90445, Honolulu, Hi. 96835

[21] Appl. No.: 594,464

[22] Filed: Mar. 28, 1984

[51] Int. Cl.[4] ..... B63H 9/06

[52] U.S. Cl. ..... 114/103; 114/39

[58] Field of Search ..... 114/39, 90, 102–104, 114/108, 99, 97, 98; 441/74

[56] References Cited

U.S. PATENT DOCUMENTS

| | | | |
|---|---|---|---|
| 2,561,253 | 7/1951 | Wells-Coates | 114/112 |
| 2,569,318 | 9/1951 | Kersten | 114/90 |
| 3,147,729 | 9/1964 | Barnard | 114/103 |
| 3,593,353 | 7/1971 | Schmalfeldt | 441/74 |
| 3,795,215 | 3/1974 | Butler | 114/90 |
| 3,835,804 | 9/1974 | Jackson | 114/107 |
| 3,866,558 | 2/1975 | Bergstrom et al. | 114/90 |
| 3,882,810 | 5/1975 | Roeser | 114/112 |
| 4,016,823 | 4/1977 | Davis | 114/90 |
| 4,064,821 | 12/1977 | Roberts | 114/103 |
| 4,149,482 | 4/1979 | Hoyt | 114/106 |
| 4,267,790 | 5/1981 | Hood | 114/106 |
| 4,335,669 | 6/1982 | Hackney | 114/103 |
| 4,388,888 | 6/1983 | Gushurst, Jr. | 114/90 |
| 4,418,631 | 12/1983 | Frohbach | 114/97 |

FOREIGN PATENT DOCUMENTS

| | | | |
|---|---|---|---|
| 3003529 | 8/1981 | Fed. Rep. of Germany | 114/97 |
| 2097741 | 11/1982 | United Kingdom | 114/97 |

*Primary Examiner*—Trygve M. Blix
*Assistant Examiner*—C. T. Bartz
*Attorney, Agent, or Firm*—Christensen, O'Connor, Johnson & Kindness

[57] ABSTRACT

A sailing system in the form of a sailboard apparatus (20) having a board (22), a mast (24) extending upwardly therefrom for supporting a sail (28). A plurality of elongate, flexible battens (30) extend through pockets (31) formed in the sail (28) to engage with corresponding batten sockets (32) disposed within the sock portion (80) of the sail. Each batten socket (32) includes a forward arcuate portion (110) adapted to swivel about mast (24) and rearwardly extending, arcuate side flanges (112) defining a narrow gap (114) for receiving batten (30) therein. A fabric hinge (118) restrains the forward end portion of the batten (30) against forward movement toward the mast (24) while being substantially free from restraining the forward end portion of the batten (30) against side to side movement between the socket flanges (112) in response to changes in the curvature of batten (30). The bottom socket (32) imports a bending moment on the batten (30) to increase the curvature of the forward portion of the batten, thereby contouring the side (29) so that the maximum draft is located on the forward portion of the sail (28).

12 Claims, 11 Drawing Figures

SAILING SYSTEM

TECHNICAL FIELD

The present invention relates to wind-propelled apparatus and, more specifically, to a sailing system for small watercraft or ice or land vehicle in which a sail is manually manipulated by the user for steering or otherwise controlling the craft or vehicle.

BACKGROUND OF THE INVENTION

Sails for use on small watercraft, such as sailboards, on ice boats or on land vehicles, such as large skateboards, have been developed wherein a mast or spar is secured by a universal-type joint to the sailboard or other type of platform on which the user stands. A generally triangularly shaped sail is mounted on the mast and a wishbone-type boom extends rearwardly from the mast. The sail is disposed between the two curved arms of the boom. The contour of the sail is preset with an outhaul attaching the clew of the sail to the rear of the boom and a downhaul attaching the tack of the sail to the bottom of the mast. Unlike the situation in larger, more sophisticated sailing systems, the steering and control of the sailboard or similar type of craft is accomplished by manipulation of the sail by movement of the boom with the hands of the sailor and by selected placement of the body weight of the sailor relative to the sail and relative to the sailboard or other type of body or platform on which the mast is mounted.

Constructing a sailboard or similar type of craft in the manner described above with simplified rigging is important for minimizing the weight of the craft and also the cost of constructing the craft. In addition, the sailor, who must support the mast to keep it upright, does not have his hands free to adjust or manipulate the typical lines or rigging used on sailboats and other larger, more sophisticated types of sailing vessels. However, the rather simplistic construction of the sails and rigging of conventional sailbaords has heretofor limited the efficiency of the sail as a wind propulsion power source for the sailboard. For example, in known sailboards, a turbulent wake is generated at the juncture between the luff of the sail and the adjacent rear portion of the mast. The wake disturbs the airflow over the sail, thereby reducing the efficiency of the sail. In addition, when the sail is loaded by the wind, the mast not only is bent laterally leeward away from the sailor who is typically located windward of the sail, but also is bent in the aft direction. This bending of the mast imparts a tension load on the sail in the fore and aft direction causing the sail to flatten out and thus assume an inefficient airfoil shape. In addition, with the aft bending of the mast, the clew to head distance is decreased thus allowing the leech to fall off. The resulting flatter sail produces a higher pressure on the leeward side of the luff, thereby causing a more negative aerodynamic moment which decreases the efficiency of the sail.

Accordingly, it is a principal object of the present invention to provide a sailing system for lightweight craft which is of uncomplicated construction and easily and readily controlled, and also in which the sail maintains an efficient aerodynamic shape even when highly loaded.

Means have been suggested for reducing the turbulence generated at the juncture of the sail luff and the mast. For instance, an elongated, nose-shaped sleeve has been engaged over a circular mast and the sail rollably furled within the interior of the sleeve. Although a sleeve of this nature may improve, to some extent, the efficiency of the sail, it undesirably adds a significant amount of weight to the mast. An example of a sailing system using this type of sleeve is disclosed in U.S. Pat. No. 4,149,482.

A further attempt to reduce the turbulent wake caused by the mast has been to construct the mast in an A-shaped cross section with flat, diverging, rearwardly extending sides. The sail is mounted on a mast to permit the luff to move from one side of the mast to the other so that the sail is always positioned on the leeward side of the mast. An obvious drawback of this type of mast is that it is of rather complicated construction. Moreover, turbulence has not been eliminated on the windward side of the mast. An example of this type of mast construction is disclosed by U.S. Pat. No. 3,882,810.

Another effort to reduce the turbulence caused by the mast has been to employ an exterior flap or fairing extending between the mast and the luff of the sail. The fairing typically is substantially rigid and extends the full height of the mast, thus adding considerable weight to the sailing system. Examples of such fairings are disclosed by U.S. Pat. Nos. 2,561,253 and 4,388,888.

A further attempt has been made to lessen the drag and wind resistance caused by the mast by mounting vertical rows of projections on the forward and side surfaces of the mast. The projections are said to separate the air passing around the mast in the form of a turbulent boundary layer which in theory reattaches to the sail in a manner whereby the detached airflow between the mast and sail is less than occurs in a conventional mast. An example of this type of mast construction is disclosed by U.S. Pat. No. 3,866,558.

Efforts also have been expended to selectively vary the draft of the sails of large marine vessels to produce a sail curvature suited to the current sailing conditions. In one such type of sail design, battens are positioned along the intersection of vertically adjacent sail panels. Rollers are mounted on the rearward ends of the battens to receive a leech rope having its upper end connected to the peak of the sail and its lower end spooled on a wench mounted on a boom. The downhaul on the leech rope can be adjusted to change the curvature of the battens. An example of this type of sail construction is disclosed by U.S. Pat. No. 2,561,253.

In another attempt to selectively change the curvature of the sails of rather large sailing vessels, upper and lower arms have been extended rearwardly from upper and lower portions of a mast. The rearward end portions of the upper and lower arms are engaged with intermediate portions of the sail to laterally constrain the sail. Contouring arms are employed to extend transversely outwardly from the upper and lower arms to push against the rear edge of a rather long vane which is engaged over the mast, which vane receives the luff of the sail. The distance that the contouring arms project laterally outwardly from the upper and lower arms controls the camber of the sail. It will be appreciated that a sailing system of this rather complicated construction is not practical for lightweight craft, such as sailboards. An example of this type of sail construction is disclosed by U.S. Pat. No. 4,388,888.

Lightweight sailing craft of the type which the present invention is concerned, such as sailboards, are commonly used for racing and for wave jumping. Footstraps are typically mounted on board sails at fixed locations to anchor the sailor's foot to the board. This is especially important during wave jumping wherein the board may be entirely out of the water and disposed vertically in the air while the sail is oriented horizontally, as is the sailor whose feet are anchored to the board with the footstraps and hands are grasped around the boom. A disadvantage of existing sailboards is that once airborne, the sailor cannot move his feet into other positions, thus often resulting in less than ideal placement of his feet for airborne dynamics. In addition, many individual stationary footstraps are required for the sailboard. Also, conventional booms do not allow for any significant change in the vertical position of the sailor's hands, which, in turn, limits the extent to which the position of the body mass of the sailor can be varied relative to the center of effort of the sail. This is especially significant during wave jumping, wherein if the body can be placed close to the center of effort of the sail, the sailor can achieve level flight by using his sail as the wing, rather than the sailor being pitched forwardly along with the sailboard.

Accordingly, it is also an object of the present invention to provide a sailing system for lightweight craft in which the position of the feet of a sailor standing on a craft can be selectively and conveniently moved relative to the board while maintaining his feet anchored to the board.

It is also an object of the present invention to provide a sailing system for lightweight craft in which the sailor's hands can be placed in variable vertical locations, thereby enabling the sailor to selectively change the position of his body relative to the sail by moving the locations of his hands.

SUMMARY OF THE INVENTION

The foregoing and other objects are achieved in accordance with the present invention by employing a plurality of elongate, flexible battens in conjunction with a sail mounted on a mast. The forward end portion of each batten is engaged within a socket which is adapted to swivel laterally relative to the mast. The socket includes rearwardly extending side flanges which converge towards each other to define a narrow gap at the rear of the socket for closely receiving a corresponding batten. A flexible fabric hinge is employed to attach the forward end of the batten to the socket. The fabric hinge includes a central loop portion extending forwardly through the socket gap into the interior of the socket for extending around the forward end of the batten thereby restraining the batten against forward movement toward the mast. The hinge, while restraining the batten against forward movement simultaneously permits the batten to shift laterally within the interior of the socket between the socket flanges in response to the degree to and lateral direction in which the batten is flexed. Means are provided at the leech portion of the sail to restrain the batten against rearward movement and also to impart a compression load on the batten, thereby causing the batten to flex laterally. When the batten is in flexed condition, the inside surface of the socket flange on the leeward side of the socket and the rear edge of the socket flange on the windward side of the socket impart a bending moment on the forward portion of the batten, thereby increasing the curvature of that section of the batten. Since the curvature of the batten defines the contour of the sail, by this construction a high camber ratio is achieved, with the maximum draft of the sail being positioned forwardly near the luff thereby contouring the sail in a highly efficient aerodynamic shape.

According to a further aspect of the present invention the luff portion of the sail is in the form of a relatively large sock which engages over the mast, the sockets and the forward portions of the battens. The battens, when loaded in compression, define the curvature of the luff on the leeward side thereof. On the windward side of the luff, the socket is in the form of a substantially flat panel extending tangentially rearwardly from the mast to the location along which the sock is attached to the rearward portion of the sail. Thus, the sock defines an asymmetric airfoil shape which is of high efficiency, especially in relation to conventional sails for sailboards and similar craft.

In another aspect of the present invention, the battens are disposed within corresponding batten pockets extending along the length of the sail forwardly from the leech. The forward ends of the pockets are in communication with the rearward gap of corresponding sockets so that the battens may be conveniently inserted through the socket gaps and into the interior of the sockets. The batten pockets may be constructed with a flexible intermediate section which stretches to enable the pockets to accommodate battens of various lengths and maintain a compression load on the battens.

According to an additional aspect of the present invention, the mast is mounted on a body or other structure which is propelled by the sail, with a body serving to support a sailor standing thereon. Foothold assemblies are mounted on the body to receive the feet of the sailor to anchor the sailor's feet to the body. The foothold assemblies are adjustably movable along the body to enable the sailor to position his feet at desired locations about the body. The foothold assemblies include a foot receiving strap, a slide attached to and depending below the foot receiving strap, and a track extending along the body means for slidably receiving and guiding the slide for movement along the track.

In another aspect of the present invention, the straps of the foothold assemblies are rotatable about an upright axis to enable the sailor to change the angle at which his feet are positioned on the body. In addition, means are provided for nominally angularly orienting the foot receiving strap in a standard orientation for ease of use by the sailor.

In a further aspect of the present invention, a boom assembly extends rearwardly from an intermediate elevation of the mast. An outhaul is used to draw the clew of the sail toward the rear of the boom. Elongate, upright handle members are mounted on the boom assembly to allow the sailor to variably position his hands at different elevations thereby enabling him to selectively alter the position of his body relative to the center of effort of the sail. This is important for the aerodynamic stability of the sail when it is disposed sideways in the manner of an aircraft wing, such as when a sailboard is used for wave jumping.

BRIEF DESCRIPTION OF THE DRAWINGS

The details of typical embodiments of the present invention will be described in connection with the accompanying drawings, in which.

DETAILED DESCRIPTION

Figure 1:
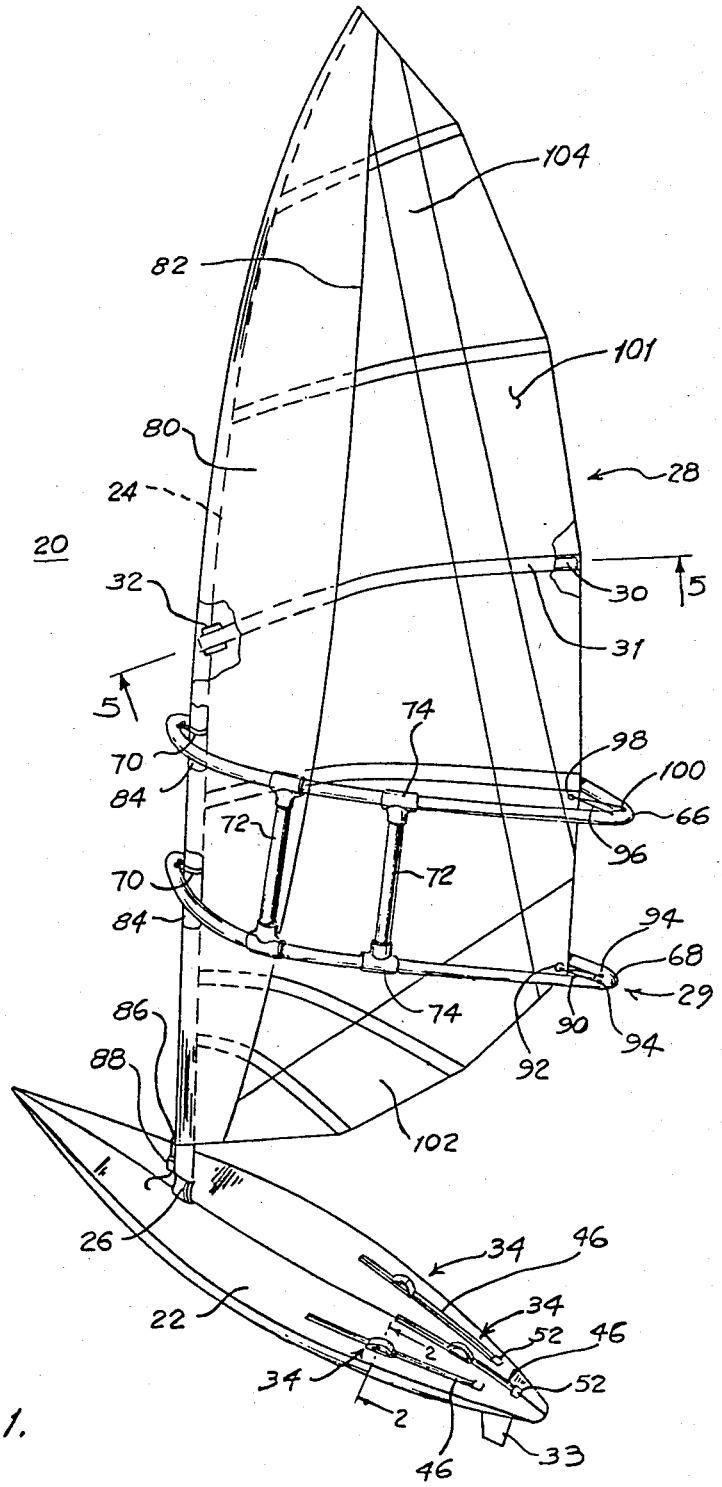
FIG. 1 is an isometric view of the sailing system of the present invention incorporated in a sailboard apparatus.

Referring initially to FIG. 1, a sailing system of the present invention is illustrated as being embodied in a watercraft in the form of a sailboard apparatus 20. Apparatus 20 includes a board 22 and a mast or spar 24 mounted on the board with a universal-type joint 26. A sail 28 constructed according to the present invention is mounted on mast 24 together with a boom assembly 29 which extends rearwardly from intermediate portions of the mast. A plurality of flexible battens 30 extend through pockets 31 formed in sail 28 to engage with corresponding sockets 32 adapted to swivel about mast 24 and impart a bending moment on the forward ends of the battens when the battens are loaded in compression, thereby to support the sail in an aerodynamically efficient shape. In use, a sailor stands on board 22 and grasps boom assembly 29 to support the mast in upright orientation and manipulate the sail for steering and otherwise controlling the operation of the sailboard apparatus 20.

Again, referring specifically to FIG. 1, board 22 is formed in an elongate shape having a typical length of approximately from 3 to 4 meters and a typical width of approximately $\frac{1}{2}$ to $\frac{3}{4}$ of a meter. Both the forward and aft ends of the board are tapered, although the aft end may be blunt, if desired. As is standard in the art, ideally the board is constructed from stiff, lightweight, water-resistant material(s), such as a foamed plastic or a fiberglass composite. A skeg 33 depends downwardly from the underside of the rear portion of board 22. A dagger board, not shown, may be employed to extend downwardly from an intermediate portion of board 22 to enhance the directional stability of the board. It is to be understood that the present invention contemplates boards of shapes other than the shape of board 22 and further contemplates that board 22 may be replaced with other types of platforms or bodies employed on small water or land craft.

Figure 2:
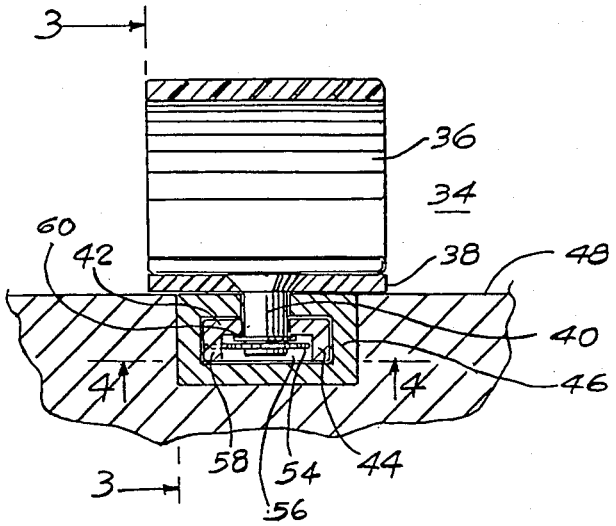
FIG. 2 is an enlarged, fragmentary cross-sectional view of a portion of the present invention shown in FIG. 1 specifically illustrating an adjustable position foothold assembly as taken substantially along section line 2—2 thereof.
Figure 3:
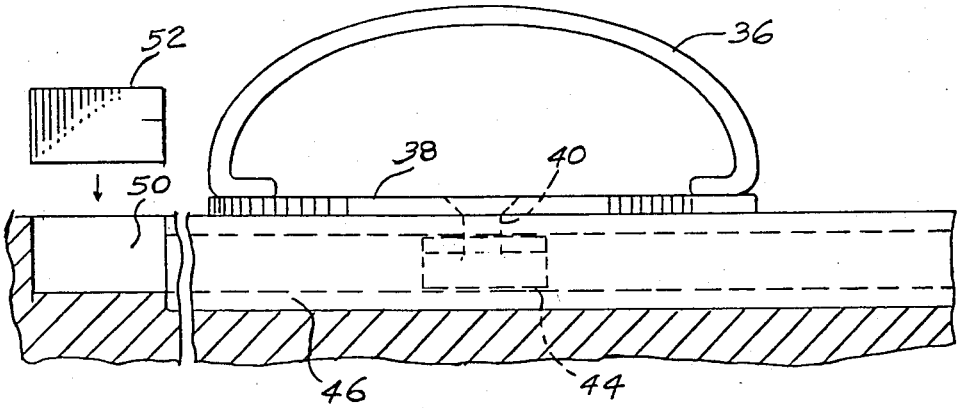
FIG. 3 is an enlarged, cross-sectional view of the adjustable position foothold assembly shown in FIG. 2 as taken substantially along section line 3—3 thereof.
Figure 4:
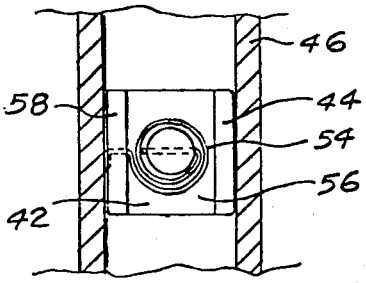
FIG. 4 is an enlarged, fragmentary bottom view of a portion of the adjustable foothold assembly shown in FIG. 3, taken substantially along section line 4—4 thereof.

Referring additionally to FIGS. 2–4, a plurality of foothold assemblies 34 are mounted on the aft portion of board 22 in such a manner that enables them to be conveniently and selectively positioned longitudinally and/or angularly relative to the board. Each foothold assembly includes an arcuate strap 36 mounted on an underlying rectangularly shaped, flat base 38. The size and shape of strap 36 is selected to conveniently receive the foot of the sailor and ideally is constructed from resilient material for comfort and to conform to the cross-sectional profile of the sailor's foot. A stud 40 extends downwardly from a central portion of base 38 to extend through a close fitting clearance hole centrally located in the upper wall 42 of a generally rectangularly shaped slide 44. Stud 40 permits strap 36 and base 38 to together rotate relative to the slide. As most clearly shown in FIG. 2, slide 44 is sized and shaped to be closely receivable within the slideway of an elongated track 46. A narrow slot extends upwardly from the slideway to the upper surface of the track to provide clearance for stud 40. Three tracks are shown in FIG. 1, which tracks are disposed generally lengthwise relative to board 22 with one track positioned substantially along the longitudinal centerline of the board and the other tracks being located on opposite sides thereof. By this arrangement, only three foothold assemblies 34 are required for proper placement of the feet, when standing on either side of the board. In known sailboards, it is not uncommon for at least 8 to 10 stationary footholds to be employed in an attempt to provide sufficient anchoring locations for the sailor's feet.

Tracks 36 may be integrally formed with board 22, or instead, may be separately constructed and then mounted within an appropriate slot formed in the upper surface 48 of the board so that the top of the track is substantially flush with upper surface 48, as shown in FIG. 2. The separately constructed tracks 46 may be securely anchored to board 22 by any convenient means, such as by use of an appropriate adhesive or fasteners, such as screws, not shown. Ideally, especially if tracks 46 are integrally constructed with board 22, a well 50 is provided at one end of each track for convenient engagement of slide 44 within the track and correspondingly for convenient disengagement of the slide from the track. The well may be formed in a generally rectangular shape corresponding to the shape of the slide. A plug 52 is employed to fill the well after slide 44 has been engaged with its corresponding track 46, thereby to prevent the slide from inadvertently disengaging from the track.

In accordance with the present invention, foothold assemblies 34 are constructed such that straps 36 are nominally oriented so that the foot openings defined thereby are transverse to the length of board 22. This is accomplished by employing a coil spring 54 disposed within a slot 56 formed in the underside of slide 44, as illustrated in FIGS. 2 and 4. The inner end of the coil spring extends through a transverse clearance hole formed in the lower end portion of stud 40 while the outer end of the spring extends through a transverse clearance hole formed in slide sidewall 58 and engages within a shallow slot formed in the outer surface of sidewall 58 to retain the outer end of the spring and prevent it from wedging against the side of the slideway formed in track 46. It will be appreciated that the sailor, by rotating his foot, can readily overcome the resistance of spring 54 to change the orientation of strap 36 relative to board 22. However, when the sailor's foot is removed from the foothold assemblies, coil springs 54 automatically return the straps to the orientations shown in FIG. 1. Of course, the nominal orientations of the straps may be changed by simply altering the construction of coil springs 54.

It will be appreciated that coil spring 54, in addition to nominally angularly orienting straps 36 in a selected position, also serves to retain the lower end of stud 40 engaged with slide 44. A flat washer 60 is interposed between spring 54 and the underside of the slide to present a substantial bearing surface against the underside of the slide.

In operation, straps 36 are simply slid along tracks 46 and angularly oriented by the movement of the sailor's foot. Once the strap is placed in desired longitudinal location and angular orientation, it is held in place by the force of the sailor's foot bearing against upper surface 48 of board 22. It will be appreciated that the locations of the straps may be changed whenever desired, even when the board 22 and the sailor are airborne, such as during wave jumping.

It is to be understood that, if desired, straps 36 can be constructed to slide along a corresponding track 46 without being rotatably relative to the underlying slide. To this end, base 38 can be fixedly pinned or otherwise secured to an underlying slide(s) 44 riding within a corresponding track 46. This somewhat simplifies the construction of foothold assembly 34.

As illustrated in FIG. 1, the lower end of mast 24 is mounted on board 22 by a universal-type joint 26 as is well known in the art. The universal joint is illustrated as being in a form of a resilient member which is substantially free from pivotal restraint so that the mast can be tilted in any desired orientation by the sailor, and also allowed to lie down on the board when not supported by the sailor. Preferably, rubber or other elastic material may be used to form universal joint 26. It is to be understood that the universal joint 26 also can be constructed in other manners, such as in the form of a ball and socket, not shown, or a gimbal, not shown, without departing from the spirit or scope of the present invention.

Mast 24 ideally tapers in the upward direction and also, preferably, the mast is hollow in construction to minimize its weight without significantly reducing its load carrying capacity, especially in bending.

Still referring specifically to FIG. 1, the present invention also includes a boom assembly 29 composed of a pair of wishbone-shaped upper and lower boom members 66 and 68 extending rearwardly in spaced, parallel relationship from an intermediate height of mast 24. The forward ends of the boom members extend around the front of the mast and are secured thereto at desired elevations along the mast by appropriate attachment arrangements 70, as are well known in the art, which permit the boom members to pivot about the mast. Upper and lower boom members 66 and 68 are interconnected by pairs of upright, elongate handle members 72 disposed on each side of the boom members. Preferably, the upper boom member 66 is located at an elevation corresponding to the center of effort of the sail, which typically is from approximately six to seven feet above board 22. Also, preferably, the handle members are from approximately two to three feet in length.

The upper and lower ends of each handle member is interconnected with a joint member 74 engaged with the boom members. Although the joint members may be constructed in any appropriate manner, in one preferred embodiment they are in the form of hollow, tubular Tee members engaged over the boom members to receive the ends of the handle members. By this construction, the location of the handle members along the lengths of the side portions of the boom members may be selectively adjusted. Any appropriate means may be employed to retain the joint members at desired locations along the boom members, such as through the use of a crosspin (not shown) or retaining ring (not shown). Ideally, the boom members and handle members are of hollow construction to minimize their weight. Also, ideally the ends of the handle members are plugged or otherwise closed off to prevent water from entering therein.

It will be appreciated that constructing boom assembly 29 in the manner described above with handle members 72, the sailor is able to conveniently change the vertical locations of his hands. This allows him to selectively alter the location of the center of gravity of his body relative to the location of the center of effort of the sail, which can be important when board sailing. For instance, when wave jumping with a sailboard, it is desired to position the sailor's body mass as close to the center of effort of the sail as possible so that the sailor can attain level flight using his sail as a wing. If the mass of the sailor is too far away from the center of effort of the sail, the sailor and sailboard will together be pitched in the forward direction.

It is to be understood that handle members similar to handle members 72 shown in FIG. 1 may be used with other types of sailboard sails including rigid, fixed wing type sails, not shown. In such instance, the handle members could be attached directly to such a wing structure.

Next, referring to FIGS. 1 and 5–8, a sail 28 is illustrated as being mounted on a mast 24. The sail is somewhat elliptical in side profile and is disposed between the sides of boom members 66 and 68. Sails of other shapes may also be employed. The luff portion of sail 28 is formed by a rather large sock 80 which engages over mast 24. Sock 80 has a horizontal, chordwise width which is substantially larger than the diameter of mast 24. As illustrated in FIG. 1, the rear edge 82 of sock 80 extends along a substantially straight line from the head to the foot of the sail. As such, the chordwise width of the sock varies along the height of the sail with the maximum width being at locations intermediate the height of the sail. Preferably, the minimum chordwise width of the sock, adjacent the head and leech of the sail, is about 5 or 6 inches while along a majority of the luff of the sail, sock 80 preferably has a horizontal width which is at least five times the diameter of the adjacent portion of the mast. This generally corresponds to the chordwise width of the sail sock extending along at least one-quarter of the chordwise length of the sail. Openings 84 are formed in the forward portion of sock 80 to accommodate the attachment arrangement 70 employed to secure the forward ends of boom members 66 and 68 to the mast. Preferably, the top of sock 80 is closed off to prevent entrance of water into the sock, for instance, when the mast is not being held upright by the sailor, and also to bear against the top of the mast. It is to be understood that additional means can be employed to secure the head of the sail to the top of the mast, as is well known in the art.

A downhaul 86 is used to secure the tack portion of the sail to the lower end of mast 24. In a manner well known in the art, the downhaul may be composed of a rope or line tied to a reinforced eye or grommet, not shown, mounted on the tack portion of the sail. The opposite end of the line may be tied to a cleat 88, or engaged with a pully (not shown) mounted on the lower portion of mast 24. The downhaul may be adjusted to vary the tension on the luff and thus alter the draft or camber of the sail. Adjustment of the downhaul also, to some extent, changes the curvature of the mast.

Continuing to refer specifically to FIG. 1, a lower outhaul 90 is employed to attach the clew of sail 28 to the rear portion of lower boom member 68. As illustrated, the lower outhaul is in the form of a line which passes through a grommet 92 extending through the clew and is anchored to cleats 94 or other appropriate means on boom member 68. A pulley, not shown, may be employed in conjunction with outhaul 90 to provide a desired level of mechanical advantage when tensioning the outhaul. The lower outhaul is preadjusted for wind and other conditions to achieve the desired draft or curvature of sail 28 prior to actually sailing, as is well known in the art.

A second, upper outhaul 96 is employed in conjunction with upper boom member 66. As with lower outhaul 90, upper outhaul 96 may be in the form of a rope or line which engages through grommet 98 extending through the leech of sail 28. The upper outhaul is anchored to the rearward portion of boom member 66 through the use of cleats 100 or other means and, in addition, a pulley (not shown) may be used in conjunction with the outhaul. It will be appreciated that through the use of the second, upper outhaul 96, the curvature of sail 28 may be more closely controlled, and also leech twist may be reduced.

Figure 5:
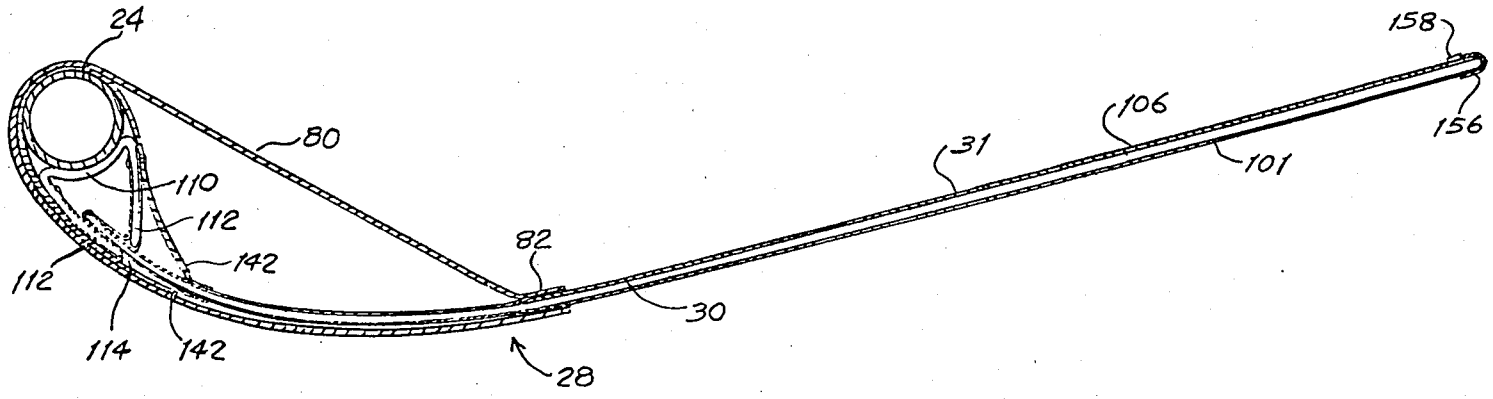
FIG. 5 is an enlarged, cross-sectional view of the present invention shown in FIG. 1 taken substantially along section line 5—5 thereof, with certain components removed for clarity.
Figure 6:
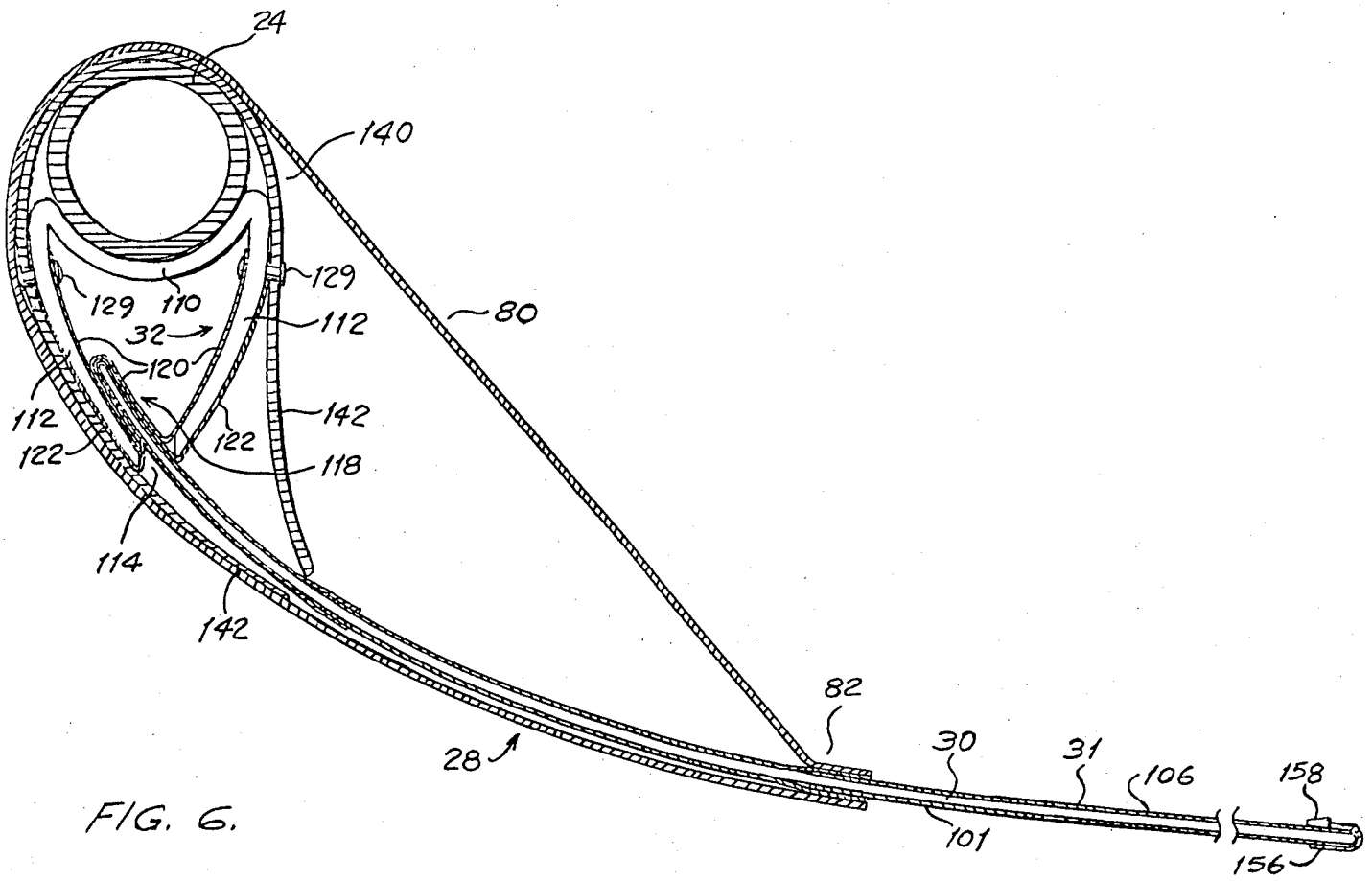
FIG. 6 is an enlarged, fragmentary cross-sectional view of the present invention similar to FIG. 5.

As shown in FIGS. 5 and 6, the sock portion 80 of sail 24 is composed of two spaced-apart panels or a single continuous panel that extends around the mast and is secured to the rear portion 101 of the sail. The sock, as discussed more fully below, defines a three-dimensional airfoil. The rear portion 101 of the sail may be composed of a single panel, thereby to reduce the weight of the sail. Ideally, a lower reinforcement panel 102 extends along the foot of the sail between the tack and the clew to enhance the ability of the sail to carry tension loads acting therebetween. The present invention also includes a leech reinforcement panel 104 extending in a straight line between the head and the clew of the sail to carry directly the tension load acting between these portions of the sail. Ideally, panel 104 is no wider thn needed to carry the tension load between the head and the clew, and, thus, as shown in FIG. 1, the rear edge of panel 104 is disposed forwardly of the actual rear edge of sail 28. As a result, the weight of the sail is not necessarily increased. It will be appreciated that both foot reinforcement panel 102 and leech reinforcement panel 104 may be attached to sail 28 by stitching or other means well known in the art.

A plurality of battens 30 are disposed within longitudinally disposed batten pockets 31 extending along sail 28 to engage with a corresponding batten socket 32. Preferably, the battens are constructed from elongate, thin, stiff but flexible, nominally planar material which also is capable of carrying a substantial compression and bending load while being very light in weight. An example of such material is fiberglass. The thickness and the width of the batten may be uniform throughout the length of the batten or the batten may be tapered as desired to alter the section modulous of the batten in relation to changes in the bending load carried by the batten along its length.

The pockets 31 in which the battens are disposed ideally are sized to closely receive the battens. The pockets extend along the chord of the sail and through the interior of sock 80. The portion of the pockets extending within sock 80 are constructed independently of sail 28. The portion of the pockets extending along the rear portion 101 of the sail also can be constructed independently of the sail and then stitched or otherwise attached to the sail. Alternatively, one side panel of the rear portions of pockets 31 may be composed of sail 28 itself while the other side panel of the pocket may be composed of a strip of cloth or other sail material, such as strip 106 shown in FIG. 6, that is stitched or otherwise fastened to sail 28.

Batten sockets 32, as illustrated in FIGS. 5–8, assist in defining the curvature of the luff on the leeward side of the sail. The sockets impart a bending moment on the forward ends of the battens thereby to shape the batten and thus the leeward side of the sail in a desired, aerodynamically efficient contour. Each of the batten sockets 32 used on sailboard apparatus 20 is substantially similar in shape and construction and, thus, only the construction of one of the battens will be described with particularity. It is to be understood that this description also applies to each of the other sockets.

Socket 32 includes an arcuate forward portion 110 formed in the curvature corresponding to the curvature of the adjacent portion of the mast, thereby to bear uniformly against the mast. Socket forward portion 110 extends partially around the circumference of the mast, preferably in the range of about 120 degrees. Constructing socket forward portion 110 in this manner enables the socket to swivel laterally about the mast in response to the extent of and the direction of curvature of its corresponding batten 30, as more fully discussed below.

Socket 32 also includes curved flanges 112 which extend rearwardly from each side edge of socket forward portion 110. Flanges 112 are convex in the outward direction and converge towards each other as they extend rearwardly from forward portion 110 to define a narrow, upright gap 114 at the rear of the socket. The curvature of flanges 112 ideally correspond to the optimum desired curvature of the adjacent portion of sock 80 on the leeward side of the luff.

Preferably, socket 32 is constructed from lightweight, but rigid or substantially rigid and shock-resistant material which is matched with the material employed to form mast 24 to enable the socket to freely swivel relative to the mast. Examples of possible materials meeting these requirements include, for instance, polyvinyl chloride, and polycarbonate. It is to be understood that socket 32 may be formed from other materials besides these. Also, preferably, the height of the socket 32 corresponds to the width of the forward portion of batten 30 to sufficiently restrain the batten in the lateral direction, as discussed more fully below, but without adding undue weight to the present invention.

The forward end of batten 30 is engaged within a close fitting hinge 118 mounted on socket 32, which hinge serves as an abutment for the forward end of the batten while allowing the batten to swing back and forth between the inside faces of socket flanges 112 in response to the extent to which and the direction in which the batten is flexed. As most clearly shown in FIGS. 6 and 7, ideally, hinge 118 is constructed from two elongate layers 120 and 122 of lightweight, but substantially stretch resistant fabric material, such as DACRON TM woven cloth or other suitable polyester material, stitched together along transverse seams 124 and 126 to form a central, double thickness loop 128 extending through gap 114 and forwardly into the hollow interior of socket 32 for receiving the forward end portion of batten 30 and its corresponding pocket 31. Hinge layer 124 overlaps the inside surface of socket flange 112 while hinge layer 122 overlaps the exterior surface of the socket flange. Both hinge layers are secured to the socket flange by rivets 129 extending through clearance holes formed in both hinge layers and through an aligned hole formed in the socket flange. Ideally, the rearward edges of socket flanges 112 are rounded to avoid tearing or otherwise damaging hinge layer 122 extending therearound. Also, preferably, hinge layers 120 and 122 are stitched together along their entire side edges, thereby to encase socket flanges 112 and also to securely fasten the forward section 130 of batten pocket 31 to the two hinge layers whereby the forward section of the pocket functions as part of loop 128. Rather than being constructed in the manner described above, the forward portion 130 of pocket 31 could instead terminate just forwardly of seams 124 and 126 without actually overlapping the entire length of loop 128.

Figure 8:
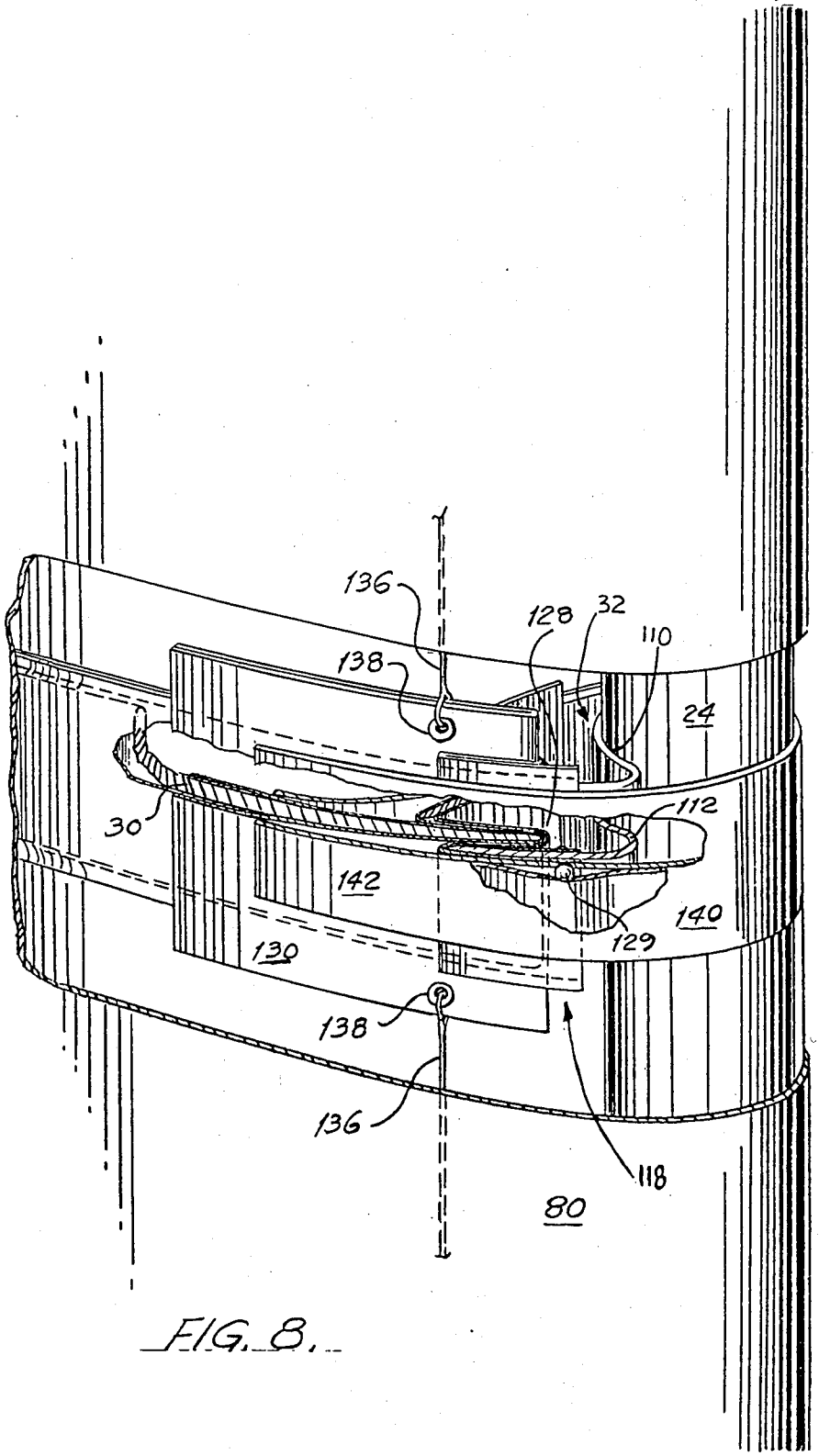
FIG. 8 is an enlarged, fragmentary, isometric view of the present invention specifically illustrating the batten and batten socket of the present invention.

Next, referring specifically to FIG. 8, lines 136 are interconnected between vertically adjacent hinges 118 to vertically support the hinges relative to each other. The upper and lower ends of lines 136 preferably extend through grommets 138 extending through the upper and lower margins of hinge layers 120 and 122 in the portion of the hinge layers disposed within the interior socket 32, i.e., the loop portion 128 of the hinge. Lines 136 thus serve to position sockets 32 relative to each other in alignment with corresponding batten pockets 31. The uppermost hinge 118 may be supported by a corresponding line 136 to an overhead portion of mast 24.

Although not essential to the present invention, a fairing 140 may be employed to provide a smooth contour for the leeward side of the sail sock 80. As most clearly shown in FIGS. 6–8, fairing 140 is constructed from a thin, elongate, flexible member which extends around the forward portion of mast 24 and is attached to the flanges 112 of socket 32 by the same rivets 129 employed to secure hinge layers 120 and 122 to the socket. The width of the fairing corresponds to the height of socket 32. By extending around the front portion of mast 24, fairing 140 maintains socket 32 in abutment against the mast; however, this typically is not required since, as long as a compression load is imparted on battens 30, sockets 32 are pressed against the mast. As shown in the figures, the fairing includes tail portions 142 which extend rearwardly from rivets 129 to a location somewhat rearward of socket gap 114. On the leeward side of sail sock 80, fairing 140 provides a continuous, smooth surface from mast 24, along socket flange 112 and along the forward portion of batten 30, i.e., the portion of the batten rearwardly adjacent socket 32. It will be appreciated that by providing a smooth contour against which the leeward side of sail sock 80 may bear, fairing 140 reduces the likelihood that turbulence will be generated along this portion of sail 28.

Figure 7:
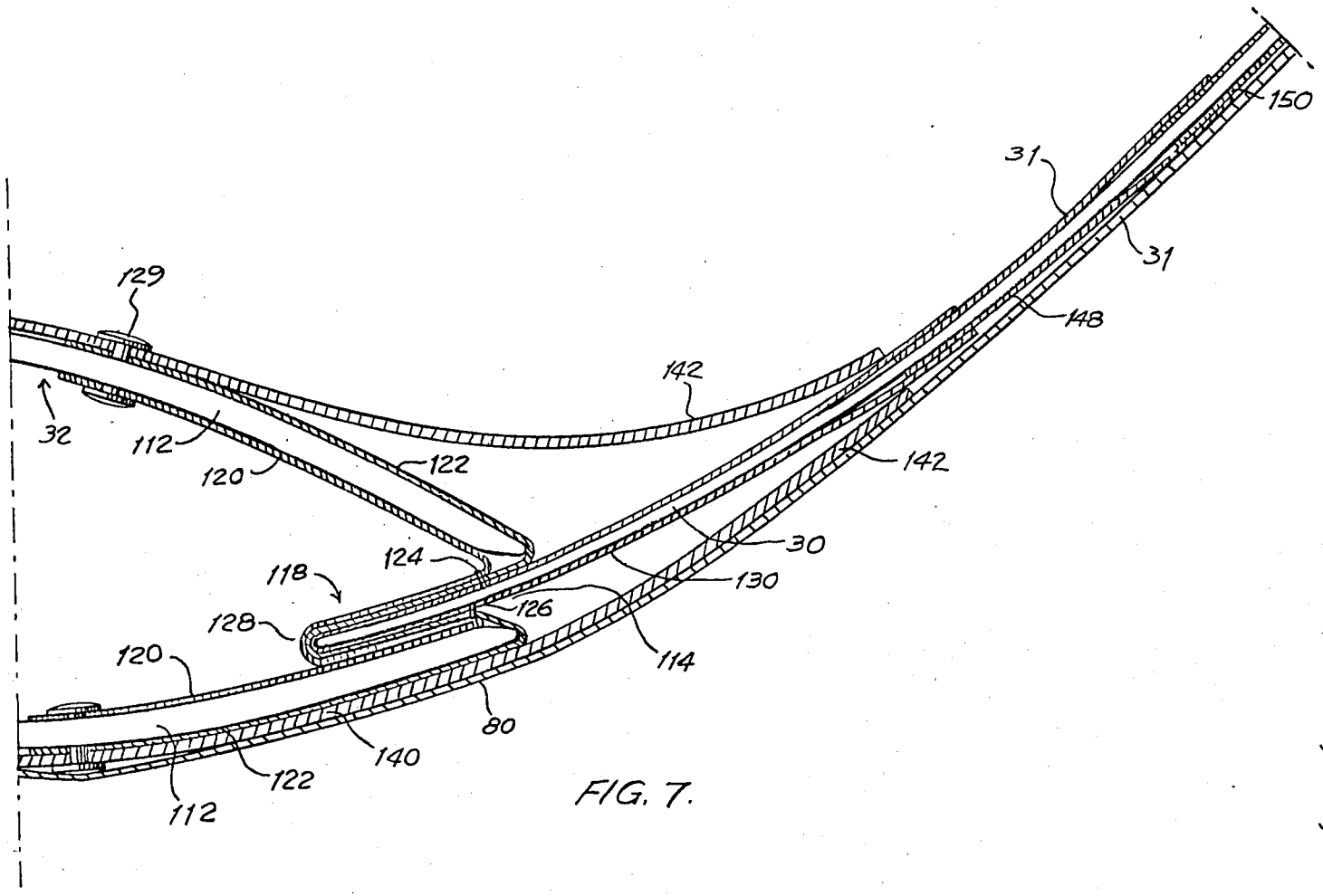
FIG. 7 is a further enlarged, fragmentary cross-sectional view of a portion of the present invention illustrated in FIG. 6.

As most clearly shown in FIG. 7, forward section 130 of batten pocket 31 extends rearwardly from hinge loop 128 to a location slightly rearwardly of the rear edge of fairing 140 to intersect with an intermediate pocket section 148 which preferably is constructed from an elastic material, thereby to enable the pocket to accommodate battens of different lengths and maintain a compression load along the length of the batten. Pocket intermediate section 148 is attached to the rear portion of pocket forward section 130 by stitching or by any other convenient means. The rearward ends of pocket intermediate section 148 in turn are stitched to or otherwise attached to the forward ends of an elongate, rearward section 150 of batten pocket 31. As shown in FIGS. 5 and 6, the rearward end of batten section 150 terminates slightly forwardly of the rear end of batten 30.

Next, referring specifically to FIGS. 5 and 6, an elongate strap 156 is secured to the leech portion of sail 28 on the leeward side of the sail. Strap 156 is secured to the sail by stitching or any other convenient means. Strap 156 is positioned in alignment with a corresponding batten pocket 31 so that the strap extends around the rearward end of the batten to engage with a buckle 158 fixedly mounted on batten pocket 31 on the windward side of the sail. Strap 156 may be selectively tightened to impart a desired compression load on batten 30, thereby to flex the batten to a desired curvature. It is to be understood that the strap 156 may be replaced with other means for applying a compression load on the batten. For instance a grommet, not shown, may be mounted within an opening formed in the luff of the sail and a second grommet, not shown, disposed in alignment thereto in the rear of pocket section 106 and then a line, not shown, may be tied between the two grommets and around the end of the batten in a manner well known in the art.

When batten 30 is flexed to the extent shown in FIGS. 5–7, the inside surface of the leeward socket flange 112 and the rear edge of the windward socket flange cooperatively laterally restrain the adjacent portion of the batten, thereby to apply a lateral moment on the batten at that location. As a result, the forward end of batten 30 is substantially more highly curved than the remainder of the batten. Since the curvature of batten 30 defines the contour of the luff portion of sail 28, by the present invention, the maximum draft of the sail is located in the forward portion of the sail adjacent socket 32. As a result, sail 28 is contoured in a significantly more efficient aerodynamic shape than may be attained in conventional sailboard sails.

Applying a compression load on batten 30 to the extent illustrated in FIGS. 5 and 6 also results in the windward side of sail sock 80 being stretched into a flat, planar shape that extends tangentially rearwardly from mast 24 to the rear edge 82 of the sock. As such, the forward portion of sail 28, as formed by sock 80, is maintained in an asymmetric three-dimensional shape by battens 30 rather than being in a flat, two-dimensional shape as in the manner of conventional sails. As a result, sock 80 defines a substantially more efficient aerodynamic shape than if this section of the sail were flat. It is to be appreciated that, if desired, sock 80 could be extended for the full chord length of sail 28 so that the entire sail defines an efficient, three-dimensional double surface wing.

When changing the angle of attack of sail 28, for instance, when shifting from a port to a starboard reach, the wind pressure is imposed on the opposite side of the sail which causes battens 30 to flex in the reverse direction from that shown in FIGS. 5–7. As this change in the flexure of battens 30 takes place, sockets 32 freely swivel about mast 24, in the counterclockwise direction shown in FIGS. 5–7, so that the forward ends of the batten bears against the opposite flange 112 of socket 32. When this occurs, the cross-sectional profile of sail 28 will be the mirror image of that shown in the figures.

As mentioned above, when sail 28 is loaded by the wind, mast 24 is bent both laterally away from the sailor and in the aft direction. This bending of the mast imparts a tension load along the length of the luff of the sail and also a tension load acting along the chord of the sail tending to cause the sail to flatten out and thus lose its efficient airfoil shape. However, the battens 30, being loaded in compression, resist the chordwise tensioning and, thus, also the flattening of the sail, thereby maintaining the sail in an asymmetric, aerodynamically efficient shape which, heretofore, has not been possible for sails used on sailboards in similar craft.

Figure 9:
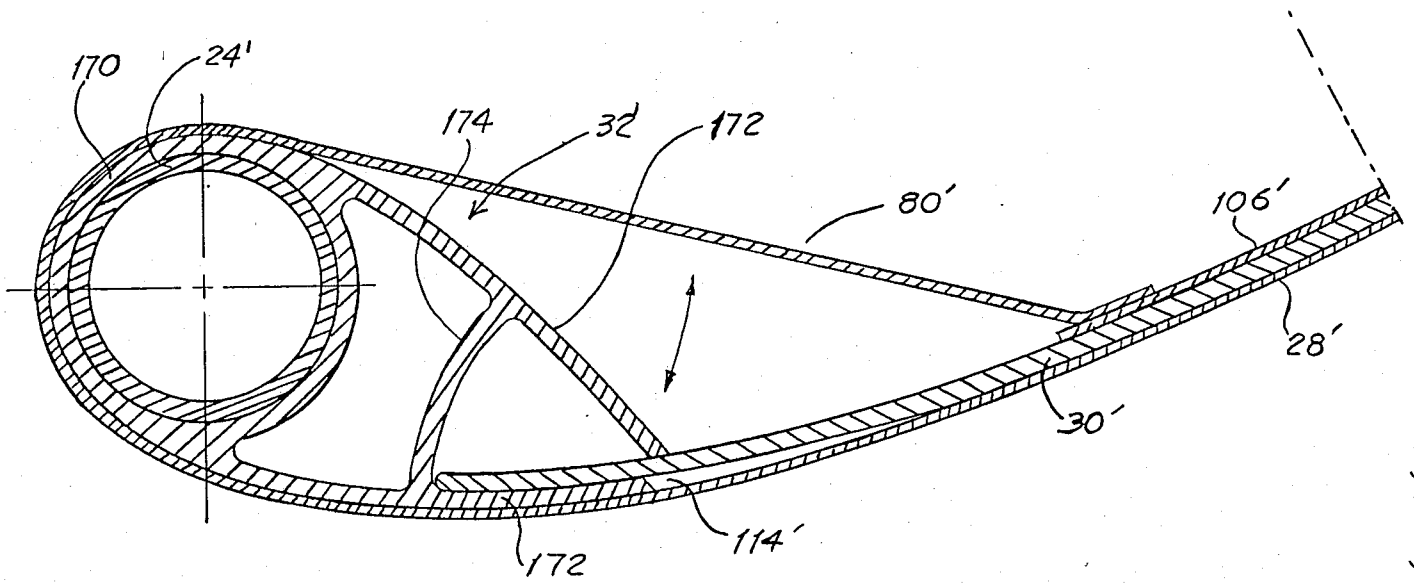
FIG. 9 is a fragmentary cross-sectional view similar to FIG. 6 illustrating an additional preferred embodiment of a batten socket of the present invention.

FIG. 9 illustrates another preferred embodiment of the present invention wherein a batten socket 32' is constructed with a forward circular portion 170 which closely extends around the circumference of a mast 24' while enabling the socket to freely rotate about the mast. Socket 32' also includes curved flanges 172 which extend tangentially rearwardly from opposite sides of circular portion 170 to converge towards each other in the rearward direction to define a narrow, upright gap 114' at the rear of the socket. In a manner similar to the construction of socket 32, flanges 172 are concave outwardly at an optimum desired curvature for the leeward side of the sail luff. In place of hinge 118 employed in conjunction with socket 32, the forward portion of batten 30' is restrained by an arcuate abutment member 174 which spans between socket flanges 172 and is concave in the rearward direction. Abutment member 174 prevents the forward movement of batten 30' while enabling the batten to freely move from side to side within socket 32' as the batten pivots about gap 114'. Thus, it will be appreciated that abutment member 174 provides substantially the same advantages as provided by hinge 118 discussed above.

Although not essential, ideally, a batten pocket, not shown, is employed in conjunction with sail 28', which batten pocket preferably is in communication with gap 114' of socket 32'. The batten pocket, not shown, constructed in this manner would assist in engaging the forward end of batten 30' within gap 114' as the batten is slid forwardly along the pocket, not shown. Other than the above-described differences, ideally, the sailing system shown in FIG. 9 is constructed in substantially the same manner as the sailing system illustrated in FIGS. 1–8, and described previously. Accordingly, a description of the remaining components of the sailing system shown in FIG. 9 will not be repeated here. It will also be appreciated that the sailing system shown in FIG. 9 provides the same advantages as provided by the sailing system shown in FIGS. 1–8 above.

Figure 10:
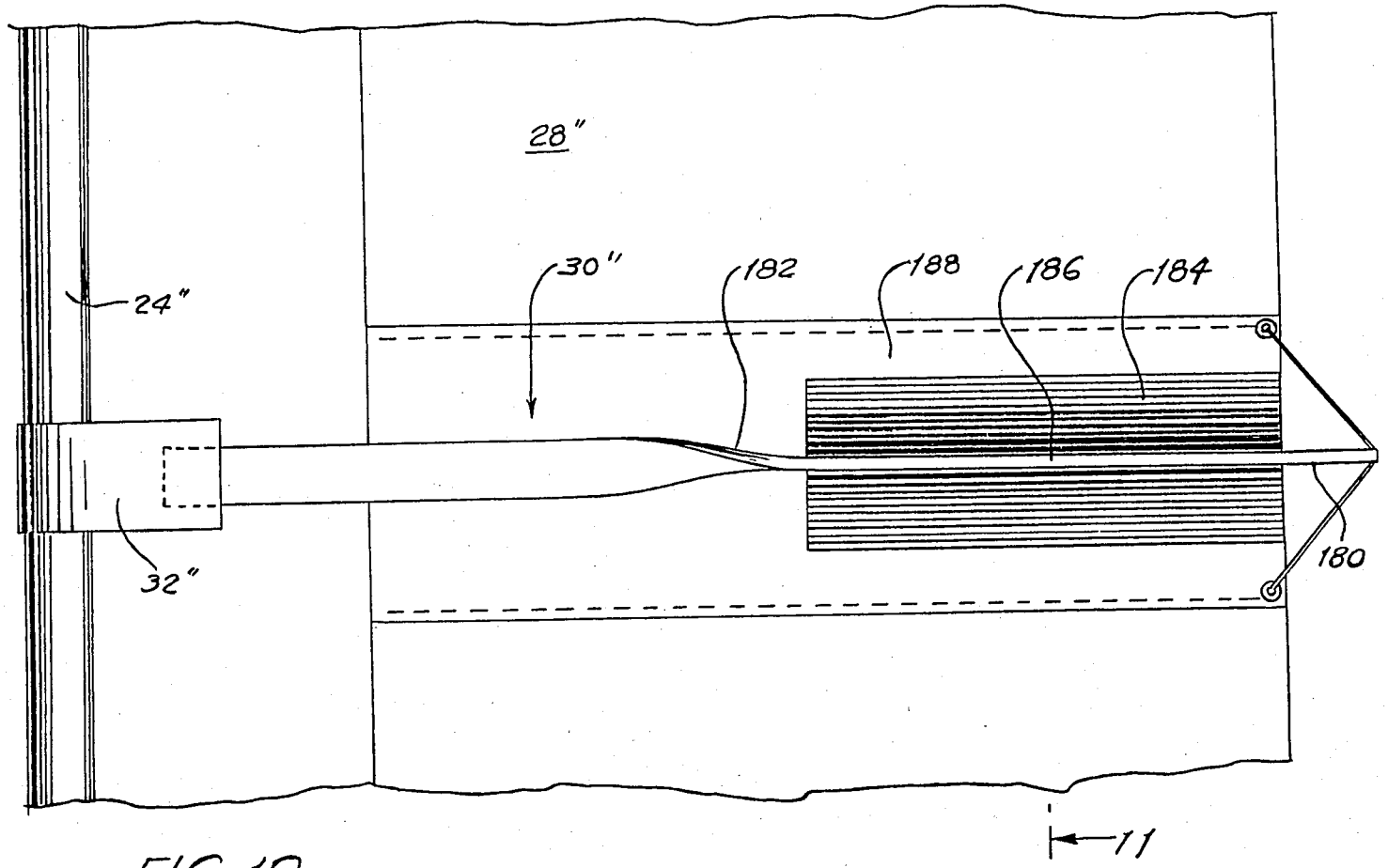
FIG. 10 is a side elevational view of an additional preferred embodiment of a batten constructed according to the present invention; and, FIG. 11 is an enlarged, cross-sectional view of the batten illustrated in FIG. 10, as taken substantially along line 11—11 thereof.
Figure 11:
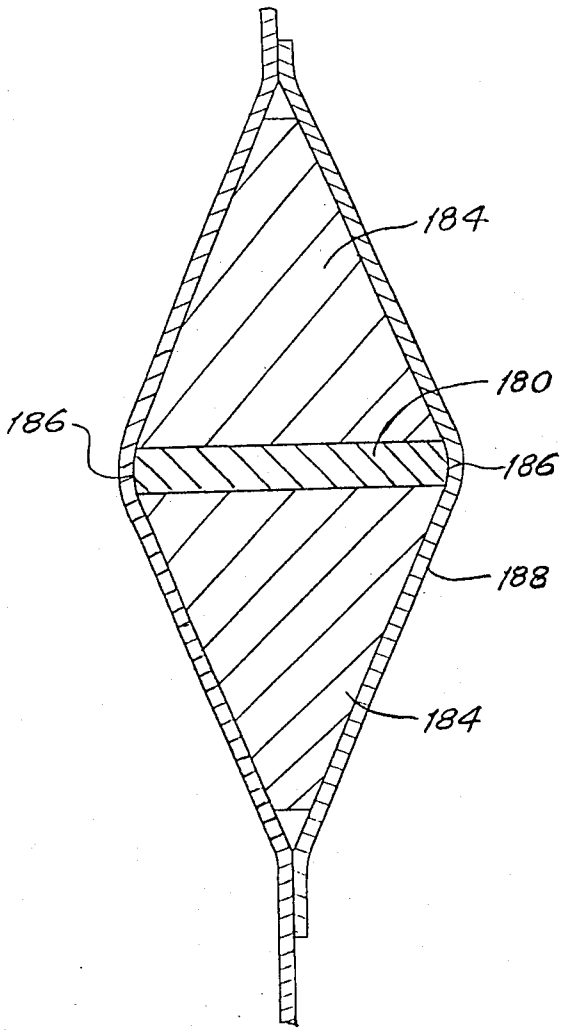

FIGS. 10 and 11 illustrate a further preferred embodiment of the present invention wherein a batten 30'', rather than being flat along its entire length, is twisted 90° at an intermediate location 182 along the length of the batten so that the rearward portion 180 of the batten is disposed horizontally rather than vertically. It will be appreciated that this substantially enhances the lateral section modulous of batten aft portion 180. By stiffening the rearward portion 180, the batten is better able to maintain the desired curvature of a sail, especially in the leech section of the sail.

As shown in FIG. 10, the twisted portion 182 of batten 30'' extends along a substantial length of the batten, thereby avoiding weakening this portion of the batten, especially for resisting bending and compression loads. Preferably batten 30'' is formed from tough, flexible, lightweight material, such as polycarbonate.

Referring additionally to FIG. 11, elongate reinforcing members 184 composed of foam or similar material that is lighweight, water-resistant, and also capable of resisting compression loads, is adhered or otherwise fixedly secured to the upper and lower surfaces of batten rearward section 180, thereby to increase the stiffness of the rear section of the batten in the vertical direction without significantly increasing the weight of the batten. Preferably, in cross section reinforcement, members 184 are shaped in a triangular cross section to provide a smooth transition between the flat plane of the sail and the side edges 186 of the rearward section 180 of batten 30''. It will be appreciated that batten pocket 188 is sized to closely receive batten rearward section 180 together with the triangular-shaped reinforcing members 184.

As discussed above, although the present invention may be especially advantageously employed with craft having a flexible mast, it will be appreciated that the present invention, including battens 30, sockets 32, enlarged sock 80, will improve the aerodynamic efficiency of sailing systems having substantially rigid masts. These and other components of the sailing system of the present invention will assist in contouring the sail mounted on a rigid mast in an asymmetric, aerodynamically efficient shape.

As will be apparent to those skilled in the art to which the invention is addressed, the present invention may be embodied in other forms other than those specifically disclosed above without departing from the spirit or essential characteristics of the invention. The particular embodiments of the various sailing systems and components thereof described above are therefore to be considered in all respects as illustrative and not restrictive. The scope of the present invention is, as set forth in the appended claims rather than being limited to the examples of the sailing systems and components thereof, set forth in the foregoing description.

The embodiments of the invention in which an exclusive property or privilege is claimed are defined as follows:

1. A sailing system for propelling body means having a mast mounted thereon, said sailing system comprising:

A. a sail supportable on the mast and having a double paneled luff section;

B. at least one socket comprising:

a forward portion in cooperative load transferring association with the mast to enable said socket to transfer loads to said mast and simultaneously swivel laterally relative to the mast; and side flanges extending rearwardly from said forward portion and converging towards each other in the rearward direction to define a gap;

C. a flexible batten extending along said sail and having a forward portion extending between the panels of the luff section, through the socket gap and into a corresponding socket, and having a rear end portion;

D. wherein said socket further comprising forward restraining means bearing against the forward portion of said batten for restraining said batten against endwise movement in the forward direction while simultaneously enabling the forward end portion of said batten to shift laterally relative to said socket in response to the angle of attack of said sail;

E. rear restraining means anchored to the sail leech for applying a selective load against the rear end portion of said batten to impart a compression load on said batten thereby loading the forward end portion of said batten against said socket and in turn loading said socket against the sail mast; and, F. wherein said forward restraining means of said socket comprise a hinge having a flexible loop extending forwardly from the gap of said socket into the interior of said socket, said loop receiving the forward end portion of said batten and restraining forward movement of said batten while being substantially free from lateral restraint of the forward end of said batten.

2. The sailing system according to claim 1, wherein said loop having means for restraining movement of the forward end portion of said batten in the direction along the luff.

3. The sailing system according to claim 1, further comprising a batten pocket for receiving said batten therein, said batten pocket having a forward end portion in communication with the loop of said hinge.

4. A sailing system for propelling body means having a mast mounted thereon, said sailing system comprising:

A. a sail supportable on the mast;

B. at least one socket comprising:

a forward portion in cooperative association with the mast to enable said socket to swivel laterally relative to the mast; and;

side flanges extending rearwardly from said forward portion and converging towards each other in the rearward direction to define a gap;

C. a flexible batten extending along said sail and having a forward portion extending through the socket gap and into said socket;

D. rear means for restraining the batten against endwise movement toward the leech;

E. forward means for restraining said batten against endwise movement toward the luff while simultaneously enabling the forward end portion of said batten to shift laterally relative to said socket in response to the angle of attack of said sail, said forward restraining means:

coacting with said rear restraining means to impart a compression load on said batten; and, comprising a hinge having a flexible loop extending forwardly from the gap of said socket to the interior of said socket, said loop receiving the forward end portion of said batten and restraining forward movement of said batten while being substantially free from lateral restraint of the forward end of said batten; and, F. a batten pocket for receiving said batten therein, said batten pocket having a forward end portion in communication with the loop of said hinge, wherein a portion of said batten pocket adjacent said socket being elastic to accommodate battens of various lengths.

5. A sailing system for propelling body means having a mast mounted thereon, said sailing system comprising:

A. a sail supportable on the mast;

B. at least one socket comprising:

a forward portion in cooperative association with the mast to enable said socket to swivel laterally relative to the mast; and, side flanges extending rearwardly from said forward portion and converging towards each other in the rearward direction to define a gap;

C. a flexible batten extending along said sail and having a forward portion extending through the socket gap and into said socket;

D. rear means for restraining the batten against endwise movement toward the leech;

E. forward means for restraining said batten against endwise movement toward the luff while simultaneously enabling the forward end portion of said batten to shift laterally relative to said socket in response to the angle of attack of sail, said forward restraining means coacting with said rear restraining means to impart a compression load on said batten; and, F. boom means having a pair of vertically spaced apart boom members extending rearwardly from the mast, and elongate handle means extending between said boom members.

6. The sailing system according to claim 5, wherein said handle means includes a pair of upright, spaced apart handle members adjustably positionable along said boom members.

7. A sailing system for propelling body means having a mast mounted thereon, said sailing system comprising:

A. a sail supportable on the mast;

B. at least one socket comprising:

a forward portion in cooperative association with the mast to enable said socket to swivel laterally relative to the mast; and;

side flanges extending rearwardly from said forward portion and converging towards each other in the rearward direction to define a gap;

C. a flexible batten extending along said sail and having a forward portion disposed vertically edgewise, extending through the socket gap and into said socket, and having a rearward section disposed horizontally edgewise;

D. rear means for restraining the batten against endwise movement toward the leech; and, E. forward means for restraining said batten against endwise movement toward the luff while simultaneously enabling the forward end portion of said batten to shift laterally relative to said socket in response to the angle of attack of said sail, said forward restraining means coacting with said rear restraining means to impart a compression load on said batten.

8. The sailing system according to claim 7, wherein the forward and rearward sections of said batten being interconnected by an intermediate twisted section.

9. The sailing system according to claim 7, further comprising elongate, lightweight reinforcing members disposed along at least one of the upper and lower surfaces of the rearward section of said batten.

10. An airfoil of a selectively controllable contour mountable on a spar, said airfoil comprising:

A. a sail supportable on said spar, said sail having a relatively large sock engaged over said spar, said sock extending chordwise rearwardly along said sail a distance of at least five times the width of said spar along substantially the entire elevation of said sock;

B. a plurality of sockets spaced apart along said spar, each comprising:

a forward portion in cooperative load transferring association with said spar to enable said socket to transfer loads to said spar and simultaneously swivel laterally relative to said spar in response to the shape of said sail; and side flanges extending rearwardly from said forward portion to define a gap at the rear of said socket, said gap extending generally lengthwise relative to the length of said spar;

C. a plurality of flexible battens extending along said sail, said battens having forward portions extending through said sail sock, closely through a corresponding socket rear gap and disposed within said socket, and rear portions at the leech of said sail;

D. wherein said socket further comprising forward restraining means bearing against the forward portion of said battens for restraining a corresponding batten against endwise movement toward the spar while permitting the forward end portion of said batten to shift laterally within said sockets between the socket flanges in response to the angle of attack of said sail; and, E. rear means anchored to the leech of said sail for applying a selective load on the rear portions of said battens to force the forward portion of said battens against corresponding sockets and in turn load said sockets against said spar thereby applying a desired compression load on said battens to cause said battens to assume an arcuate shape along their lengths and apply a corresponding tensile load on said sail in the direction along the lengths of said battens, with the arcuate shape of said battens defining the curvature of the leeward side of said sail sock and maintaining said sock in taut condition whereby said sock defines an asymmetrical, double surface airfoil; and, F. wherein said forward restraining means comprise hinge means having a flexible loop extending forwardly from the gap of a corresponding socket into the interior of said socket, said loop receiving the forward end portion of a corresponding batten and restraining forward movement of the batten toward the spar while being substantially free from lateral restraining of the forward end of the batten.

11. The airfoil according to claim 10, further comprising a batten pocket for receiving a corresponding batten therein, said batten pocket having a forward end portion in communication with the loop of a corresponding hinge means.

12. The airfoil according to claim 11, wherein said batten pocket having a elastic section to enable said batten pocket to accommodate battens of varying lengths.

* * * * *